US005808636A

United States Patent [19]

Stearns

[11] Patent Number: 5,808,636

[45] Date of Patent: Sep. 15, 1998

[54] REDUCTION OF DROPLET MISDIRECTIONALITY IN ACOUSTIC INK PRINTING

[75] Inventor: Richard G. Stearns, Santa Cruz, Calif.

[73] Assignee: Xerox Corporation, Stamford, Conn.

[21] Appl. No.: 710,193

[22] Filed: Sep. 13, 1996

[51] Int. Cl.[6] ..... B41J 2/135

[52] U.S. Cl. ..... 347/46

[58] Field of Search ..... 347/46, 47, 15

[56] References Cited

U.S. PATENT DOCUMENTS 4,602,852 7/1986 Moroz ..... 350/358
4,748,852 6/1988 Elrod ..... 347/46

OTHER PUBLICATIONS

Hadimioglu et al. "Acoustic Ink Printing", IEEE 1992 Ultrasonics Symposium (Cat No. 92CH3118–7), NY,NY, 1992, pp. 929–935, vol. 2.

Imaino et al. "Acoustic Dispersion And Attenuation In Toners" Photographic Science And Engineering, vol. 28, No. 6, Nov./Dec. 1984.

*Primary Examiner*—Benjamin R. Fuller
*Assistant Examiner*—Charlene Dickens
*Attorney, Agent, or Firm*—Oliff & Berridge, PLC

[57] ABSTRACT

A method of ejecting a droplet of a fluid from a surface of the fluid includes the step of generating an acoustic wave to eject the droplet from the fluid surface. The acoustic wave is shaped into an optimal toneburst such that the droplet is ejected substantially in a direction of acoustic wave propagation substantially independent of an orientation of the fluid surface.

16 Claims, 5 Drawing Sheets

REDUCTION OF DROPLET MISDIRECTIONALITY IN ACOUSTIC INK PRINTING

BACKGROUND OF THE INVENTION

1. Field of the Invention

The invention relates to acoustic ink printing. In particular, the invention relates to reducing the misdirectionality of ejected droplets by shaping acoustic tonebursts.

2. Description of Related Art

In acoustic ink printing, focused sound waves are used to eject droplets of ink from an air-ink interface. A conventional printhead includes an array of ejectors.

FIG. 1 is a schematic of an ejector of a printhead showing an ideal relationship between a direction of propagation of an acoustic wave and a direction of droplet ejection. A transducer 4 and a lens 9 are disposed on is opposite sides of a wafer 11. The wafer 11 is preferably formed of glass. A thin metal plate 13 is spaced vertically from the wafer 11. The metal plate 13 defines an aperture 8. The aperture 8 is disposed adjacent the lens 9 and the transducer 4. A fluid 5, preferably aqueous ink, is disposed between the metal plate 13 and the wafer 11. An air space 15 is disposed on the side of the metal plate 13 opposite the aqueous ink 5. An air-ink interface 7 is disposed at the aperture 8 of the metal plate 13.

In the operation of the ejector, the transducer 4 generates an ultrasonic wave in the aqueous ink 5. Dotted lines indicate the boundary of the acoustic wave. The direction of acoustic wave propagation is indicated by arrow 6. The lens 9 focuses the acoustic wave to the air-ink interface 7. The aperture 8 surrounds a region of droplet formation and helps to constrain the location of the fluid surface.

Ideally, as shown in FIG. 1, the acoustic wave propagates in a direction perpendicular to the air-ink interface 7. The acoustic wave causes a droplet 10 to be ejected in a direction indicated by arrow 12, which is parallel to the direction of acoustic wave propagation indicated by arrow 6. Thus, ideally the droplet 10 is ejected in a direction perpendicular to the air-ink interface 7.

To achieve high-quality printing, the direction of ejection of the droplets 10 must be the same for all ejectors across the printhead. Very slight misdirections cause droplets to land on a substrate (not shown), e.g., paper, at a location distant from their intended locations.

Typically, a 1 mm gap separates the air-ink interface 7 from the substrate. A droplet 10 ejected one degree off from the ideal ejection direction 12 is displaced 17.5 $\mu$m from its intended location on the substrate. For a 1200 spi (spots per inch) printer, this displacement constitutes 80% of one pixel. Thus, the direction of ejection of the droplets 10 must be controlled very closely to achieve high quality printing.

A common cause of misdirectionality of droplet ejections is local tilting of the fluid surface at the air-ink interface 7 in the region of droplet formation, as shown in FIG. 2. Various anomalies can cause the fluid surface to tilt including the presence of contaminants in the aperture 8, such as dust and paper fibers. The contaminants become saturated with the fluid, thereby creating a tilt in the fluid surface. Non-ideal wetting of the aperture 8 can also cause the fluid surface to become tilted. Non-ideal wetting occurs when the contact angle between the fluid 5 and the aperture wall varies along the wall of the aperture 8, causing asymmetry of a fluid meniscus. Misalignment of the acoustic wave with a meniscus of the fluid 5 and the presence of capillary waves at the fluid surface generated by previous droplet ejections can also cause the fluid surface to become locally tilted over the region of interaction with the acoustic beam.

The industry lacks an apparatus and method for reducing misdirectionality of droplet ejections in acoustic ink printing for the purpose of achieving high quality printing.

SUMMARY OF THE INVENTION

It is therefore an object of the invention to provide an apparatus and method for reducing the misdirectionality of droplet ejections in acoustic ink printing for the purpose of achieving high quality printing. Specifically, it is an object of the invention to reduce the sensitivity of the direction of droplet ejections to a tilted fluid surface by optimally shaping an acoustic toneburst. It is also an object of the invention to reduce misdirectionality of droplet ejection that results from a non-ideal direction of propagation of the acoustic wave itself.

A method of ejecting a droplet of a fluid from a surface of the fluid includes the step of generating an acoustic wave to eject the droplet from the fluid surface. The acoustic wave is shaped into an optimal toneburst such that the droplet is ejected substantially in a direction of acoustic wave propagation substantially independent of an orientation of the fluid surface.

The acoustic wave can be generated by a piezo-electric element. For example, a zinc-oxide piezo-electric element can be used that includes a 10 micron film deposited onto a glass substrate. The acoustic wave can also be generated by sparks wherein a discharge creates shock waves in the fluid. Alteratively, the acoustic waves can even be generated by lasers.

The invention can also include the step of focusing the acoustic wave with a lens. Preferably, a Fresnel lens is used. However, other conventional lenses can also be used, such as spherical lenses.

The invention is a method of reducing the misdirectionality of droplet ejections caused by tilted fluid surfaces and misdirected acoustic waves. However, the invention is also intended to encompass an apparatus for performing this method.

Further objects, details and advantages of the invention will be apparent from the following detailed description, when read in conjunction with the drawings.

DETAILED DESCRIPTION OF PREFERRED EMBODIMENTS

Figure 2:
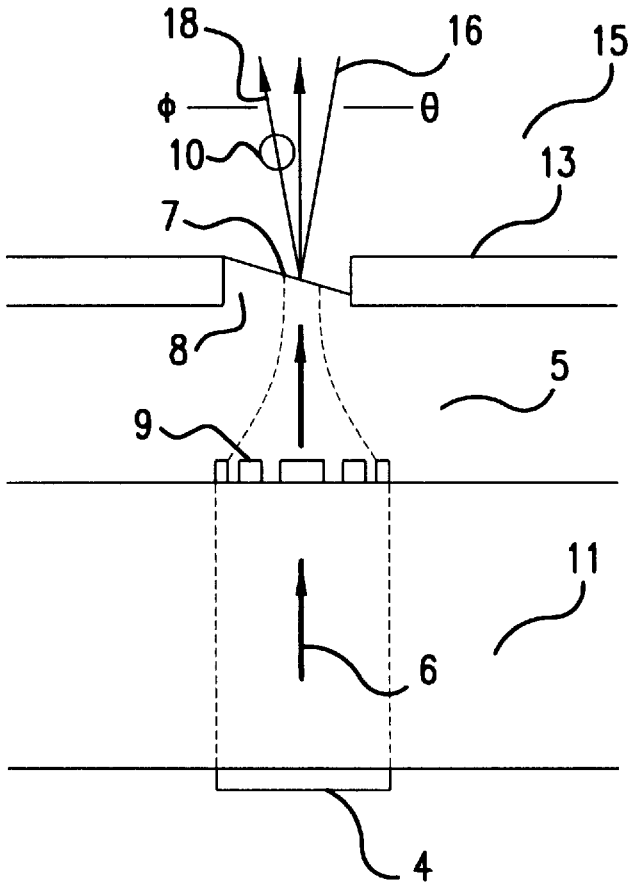
FIG.2 (PRIOR ART)
FIG. 2 is a schematic of an ejector of a printhead showing a tilted fluid surface at an air-ink interface resulting in a non-ideal relationship between a direction of propagation of an acoustic wave and a direction of droplet ejection in accordance with the conventional art.

FIG. 2 is a schematic of an ejector of a printhead showing a tilted fluid surface at an air-ink interface resulting in a non-ideal relationship between a direction of propagation of an acoustic wave and a direction of droplet ejection in accordance with the conventional art.

Figure 1:
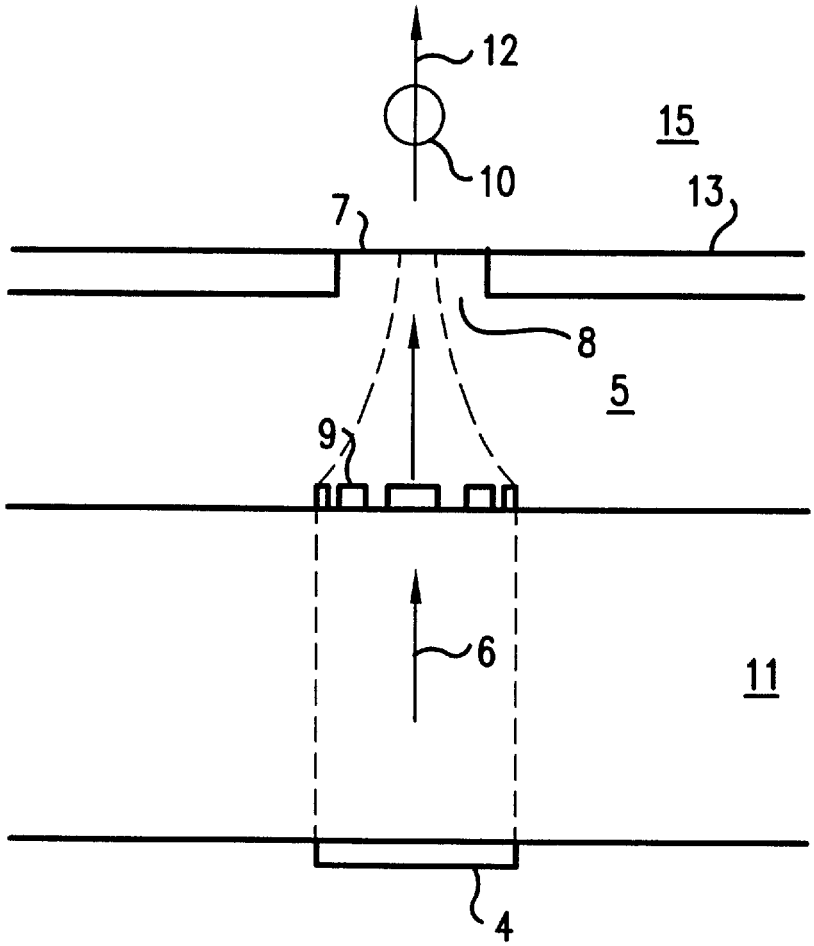
FIG. 1 is a schematic of an ejector of a printhead showing an ideal relationship between a direction of propagation of an acoustic wave and a direction of droplet ejection.

The direction of propagation of the acoustic wave is indicated by arrow 6. Angle θ represents an angle formed by a line 16 that is perpendicular to the tilted fluid surface, and the direction of acoustic wave propagation indicated by arrow 6. In the ideal situation shown in FIG. 1, the fluid surface is perpendicular to the direction of propagation of the acoustic wave such that θ=0.

Angle ϕ represents an angle formed by a direction in which the droplet 10 is actually ejected as indicated by arrow 18, and the direction of the acoustic wave propagation indicated by arrow 6. Ideally, the direction of droplet ejection is parallel to the direction of propagation of the acoustic wave.

Conventional printheads eject droplets using acoustic tonebursts of 5 μs duration at a center frequency of 165 MHz. Experiments have been conducted on fluids, including water and aqueous inks where the fluid surface is tilted, using acoustic tonebursts of 5 μs duration. The 5 μs tonebursts cause water and aqueous inks to be ejected at an angle ϕ approximately equal to —θ. For 5 μs tonebursts, droplets are ejected in a direction indicated by arrow 18 of FIG. 2. Thus, droplets are ejected on the opposite side of the ideal droplet ejection direction from line 16. The magnitude of ϕ approximately equals the magnitude of θ at 5 μs tonebursts.

Thus, acoustic tonebursts of conventional printheads misdirect droplets at an angle that is comparable to the angle of tilt of the fluid surface. Therefore, fluid surface tilt must be controlled within one degree in order to prevent droplets from being misdirected more than one degree. However, it is technically difficult to control fluid surface tilt to within one degree.

In theory, for very short acoustic tonebursts, e.g., having a duration approaching 0 μs, droplets should be ejected in a direction perpendicular to the fluid surface. Thus, droplets are ejected in the direction indicated by arrow 16, such that ϕ=θ.

The acoustic wave always interacts with each point along the fluid surface by transferring momentum in a direction normal to that local surface. The efficiency of momentum transfer depends upon the angle between the acoustic beam and the local surface normal, being greatest when they are colinear (i.e. θ=0). For very short acoustic tonebursts, the surface remains substantially stationary over the duration of the momentum transfer. The fluid surface only begins to significantly deform after the acoustic wave has transferred all of its momentum. Thus, over the duration of the short toneburst, the fluid surface remains flat, and all momentum is transferred normal to it, so that the droplet is ejected perpendicular to the surface. However, for longer acoustic tonebursts, the fluid surface begins to deform while the toneburst is still present. In this case, an asymmetry develops, as the acoustic beam transfers its momentum more efficiently over those regions of the deforming surface whose normal is aligned with the beam direction. The asymmetrical fluid surface causes the droplets to be ejected at an angle, i.e., not perpendicular to the fluid surface.

As described above, a toneburst of 5 μs duration ejects droplets at an angle ϕ=−θ. Alternatively, a toneburst of a very short duration, e.g., having a duration approaching 0 μs, ejects droplets at an angle perpendicular to the fluid surface such that ϕ=θ. Therefore, a specific toneburst between 0 and 5 μs can be used to eject droplets substantially in the direction of acoustic wave propagation such that ϕ=0. Thus, a toneburst of a duration somewhere between 0 and 5 μs allows droplets to be ejected independent of the tilted fluid surface. In other words, appropriate adjustment of the duration of a toneburst reduces the sensitivity of droplet ejection direction to fluid surface tilt.

Figure 5:
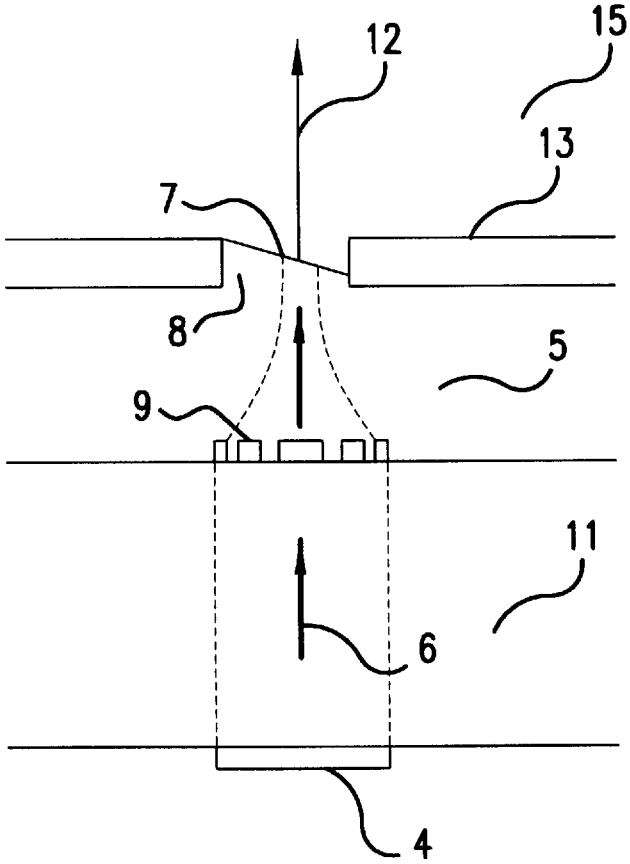
FIG. 5 is a schematic of an ejector of a printhead showing a tilted fluid surface at an air-ink interface resulting in an ideal relationship between a direction of a propagation of an acoustic wave and a direction of droplet ejection in accordance with the invention.

FIG. 5 is a schematic of an ejector of a printhead showing a tilted fluid surface at an air-ink interface resulting in an ideal relationship between a direction of propagation of an acoustic wave and a direction of droplet ejection in accordance with the invention. FIG. 5 shows that by appropriately shaping a toneburst, i.e., to between 0 and 5 μs, allows droplets to be ejected in a direction indicated by arrow 12 which is substantially in the direction of acoustic wave propagation as indicated by arrow 6, even though the fluid surface is tilted.

Figure 3:
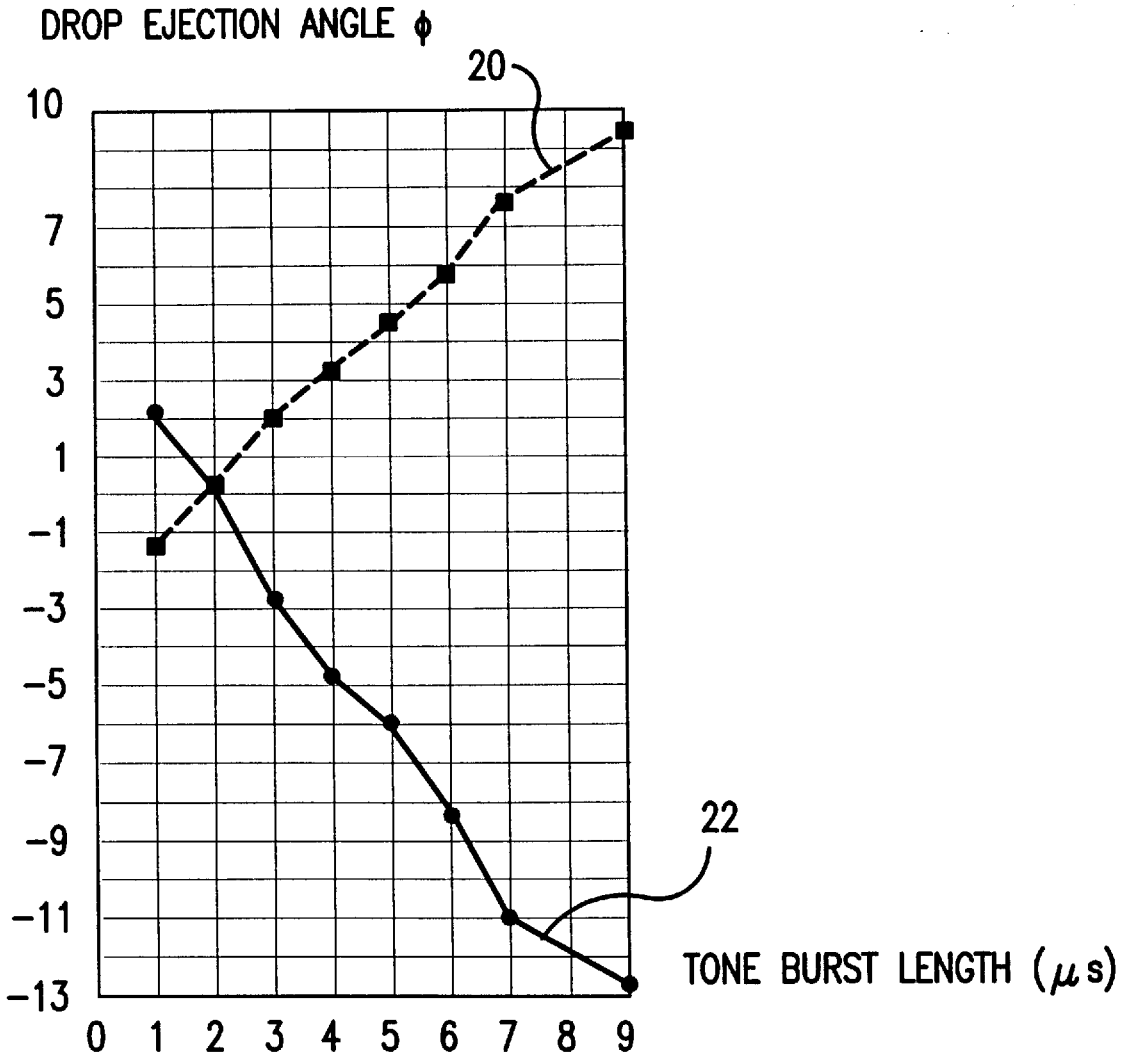
FIG. 3 is a graph showing the relationship, based upon experimental data for water, between droplet ejection angle $\phi$ and toneburst length for two angles $\theta$, each angle $\theta$ formed by the direction of propagation of an acoustic wave and a line perpendicular to a tilted fluid surface.

FIG. 3 is a graph showing the relationship, based upon experimental data for water, between droplet ejection angle ϕ and toneburst length for two angles θ, each angle θ formed by the direction of propagation of an acoustic wave and a line perpendicular to a tilted fluid surface. Dashed line 20 indicates the relationship between droplet ejection angle ϕ and toneburst length for θ=−5.5 degrees. Solid line 22 indicates this relationship for θ=7.3 degrees.

For both lines 20 and 22, droplet ejection angle ϕ equals 0 at a toneburst duration of 2 μs. Thus, acoustic tonebursts of 2 μs duration eject droplets of water along the direction of acoustic propagation, i.e., the ideal droplet ejection direction. The 2 μs tonebursts allow droplets of water to be ejected in a direction independent of fluid surface orientation. Thus, ejectors using 2 μs tonebursts eliminate the sensitivity of droplet ejections to fluid surface orientation.

Experiments conducted for several aqueous inks have produced curves similar to lines 20 and 22. In all cases, an optimal toneburst pulse, wherein ϕ=0, is achieved between 1.5 and 2.5 μs.

Figure 4:
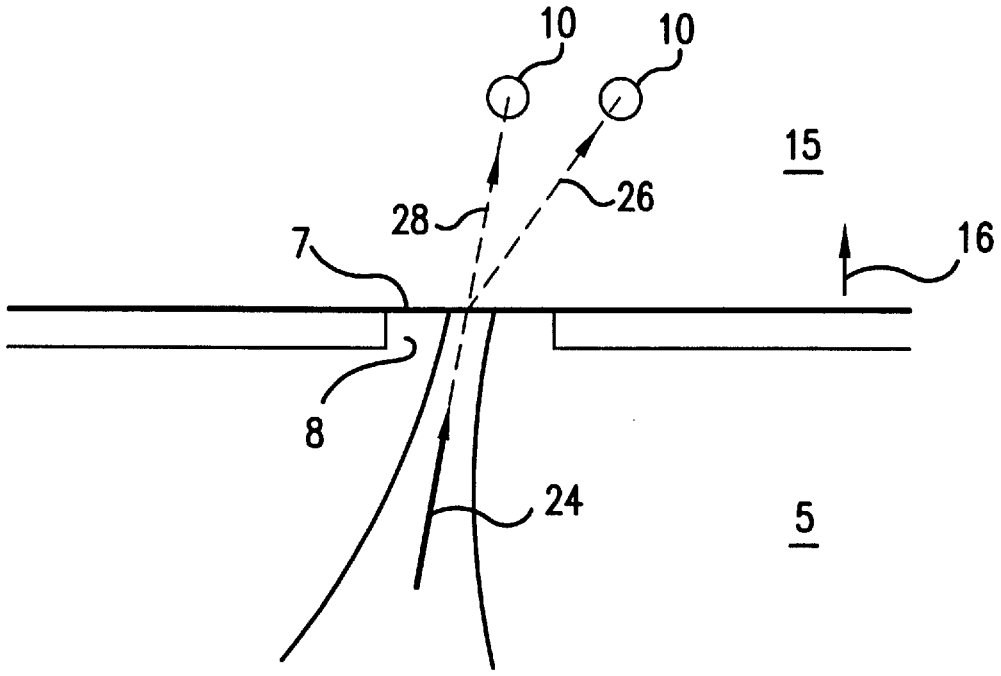
FIG. 4 is a schematic of an ejector of a printhead showing a non-ideal acoustic beam propagating at an angle relative to a fluid surface at an air-ink interface.

FIG. 4 is a schematic of an ejector of a printhead showing a non-ideal acoustic beam propagating at an angle relative to a fluid surface at an air-ink interface. Acoustic waves may propagate non-ideally due to damaged lenses or non-ideal excitation of the transducer, as well as because of interference effects with reverberating waves that may exist in the system. Misdirection of droplets due to abnormalities of the acoustic wave itself can be corrected. Droplets can be ejected in a direction perpendicular to the fluid surface by using acoustic tonebursts with a duration approaching 0 μs.

However, generating such short tonebursts is not practical technically. Also, the accuracy of ejecting droplets in a direction perpendicular to the fluid surface is dependent upon the fluid surface orientation. High quality printing will not be attained by ejecting droplets in a direction perpendicular to the fluid surface if the fluid surface is tilted.

Arrow 24 indicates an acoustic wave that propagates in a direction at an angle to the fluid surface. An acoustic wave of the conventional duration of 5 μs ejects a droplet in a direction indicated by arrow 26. Droplets are thus ejected at an angle greater than the tilt of the acoustic beam. Ejection of a droplet in the direction indicated by arrow 26 does not produce high print quality.

Misdirection of ejected droplets due to non-ideality of the acoustic wave is improved by using an acoustic toneburst of 2 μs instead of the conventional 5 μs. An acoustic toneburst of 2 μs ejects a droplet substantially in the direction of acoustic propagation, as indicated by arrow 28. The direction of ejection indicated by arrow 28 is independent of fluid surface orientation. A higher printing quality is attained by ejecting droplets in the direction indicated by arrow 28.

Controlling the duration of acoustic tonebursts also facilitates improved printing quality for high speed printing. Typically, only tens of microseconds separate droplet ejections when printing at high speeds. Capillary waves are formed as each droplet is ejected. The capillary waves are reflected from the aperture walls back toward the center of the aperture.

Capillary waves from previous droplet ejections are still present when each new droplet is formed. The capillary waves disturb the orientation of the fluid surface and thereby misdirect the direction of droplet ejections. Controlling the duration of the acoustic tonebursts reduces this dynamic misdirectionality similarly to how it optimizes droplet ejections for static tilt conditions as described above.

An experiment was conducted to verify this conclusion. A train of 10 drops was ejected onto a substrate, i.e., paper, via an aperture having a 250 μm diameter. The 10 drops were printed at both a repetition rate of 20 μs corresponding to high speed printing, and 200 μs corresponding to slow printing. Many seconds separated each train of drops. The acoustic beam was focused within ±5% of the center of the aperture.

Acoustic tonebursts of 5 μs and 2 μs were used for each repetition rate. The acoustic tonebursts of 5 μs produced fairly good results at the 200 μs repetition rate. However, the 5 μs tonebursts produced significantly misdirected droplet ejections at the 20 μs repetition rate. This misdirectionality was substantially due to capillary waves interacting with the fluid surface.

However, acoustic tonebursts of 2 μs produced high-quality results for both the 200 and 20 μs repetition rates. Thus, shaping the duration of the acoustic tonebursts to 2 μs substantially reduces dynamic misdirectionality.

The above data indicate that optimally shaping acoustic tonebursts can be used to reduce the misdirectionality of droplet ejections to achieve high quality printing. optimally shaped acoustic waves can be used to eject droplets in a direction that is insensitive to the fluid surface orientation. Optimally shaped acoustic waves also reduce the misdirectionality of droplet ejections that result from non-ideal directions of propagation of the acoustic waves. The method and apparatus for using optimally shaped acoustic waves improves the quality and robustness of acoustic printing.

While this invention has been described in conjunction with specific embodiments thereof, it is evident that many alternatives, modifications and variations will be apparent to those skilled in the art. For example, optimally shaped acoustic tonebursts can be used to reduce misdirectionality of droplet ejections for liquids other than water and aqueous inks. The optimally shaped tonebursts for liquids other than water and aqueous inks can be of any duration. In fact, the optimal toneburst duration of some liquids may be outside of the range of 1.5–2.5 μs. In addition, an optimal toneburst may contain a specific amplitude modulation over its duration, and may even be comprised of a series of shorter tonebursts, whose effect is to eject a single drop from the fluid surface.

Additionally, optimally shaped acoustic tonebursts can be used to reduce the misdirectionality of droplet ejections for applications other than printing. In fact, optimally shaped tonebursts can be used to reduce misdirectionality in nearly any application of droplet ejection.

Accordingly, the preferred embodiments of the invention as set forth herein are intended to be illustrative and not limiting. Various changes may be made without departing from the spirit and scope of the invention as defined in the following claims.

What is claimed is:

1. A method of ejecting a droplet of a fluid from a surface of the fluid, comprising the steps of:

generating an acoustic wave to eject the droplet from the fluid surface; and shaping the acoustic wave into an optimal toneburst in a range between 0 and 5 μs such that the droplet is ejected substantially in a direction of acoustic wave propagation substantially independent of an orientation of the fluid surface.

2. The method according to claim 1, wherein the fluid is selected from a group consisting of water and aqueous inks.

3. The method according to claim 1, wherein the step of shaping the acoustic wave includes shaping the acoustic wave into an optimal toneburst which is greater than or equal to 1.5 μs and less than or equal to 2.5 μs.

4. The method according to claim 1, wherein the step of shaping the acoustic wave includes shaping the acoustic wave into an optimal toneburst which is approximately 2 μs.

5. The method according to claim 1, wherein the step of generating an acoustic wave includes generating an acoustic wave with a piezo-electric element.

6. The method according to claim 1, further including the step of focusing the acoustic wave.

7. The method according to claim 1, wherein the direction of acoustic wave propagation intersects the fluid surface at an angle.

8. The method according to claim 1, wherein the droplet is ejected substantially in a direction of acoustic wave propagation substantially independent of disturbances to the fluid surface caused by capillary waves that are generated by high speed printing.

9. An apparatus for ejecting a droplet of a fluid from a surface of the fluid, comprising:

means for generating an acoustic wave to eject the droplet from the fluid surface; and means for shaping ihe acoustic wave into an optimal toneburst in a range between 0 and 5 μs such that the droplet is ejected substantially in a direction of acoustic wave propagation substantially independent of an orientation of the fluid surface.

10. The apparatus according to claim 9, wherein the fluid is selected from a group consisting of water and aqueous inks.

11. The apparatus according to claim 9, wherein the optimal toneburst is greater than or equal to 1.5 μs and less than or equal to 2.5 μs.

12. The apparatus according to claim 9, wherein the optimal toneburst is approximately 2 μs.

13. The apparatus according to claim 9, wherein the means for generating includes a piezo-electric element.

14. The apparatus according to claim 9, further including a means for focusing the acoustic wave.

15. The apparatus according to claim 9, wherein the direction of acoustic wave propagation intersects the fluid surface at an angle.

16. The apparatus according to claim 9, wherein the droplet is ejected substantially in the direction of acoustic wave propagation substantially independent of disturbances to the fluid surface caused by capillary waves that are generated by high speed printing.

* * * * *